US006872150B2

(12) United States Patent
Welch

(10) Patent No.: US 6,872,150 B2
(45) Date of Patent: Mar. 29, 2005

(54) PUTTING PRACTICE KIT AND METHOD

(76) Inventor: Dan A. Welch, 6125 - 90th Ave. SE., Mercer Island, WA (US) 98040

( * ) Notice: Subject to any disclaimer, the term of this patent is extended or adjusted under 35 U.S.C. 154(b) by 0 days.

(21) Appl. No.: 10/738,890

(22) Filed: Dec. 16, 2003

(65) Prior Publication Data

US 2004/0132539 A1 Jul. 8, 2004

Related U.S. Application Data

(60) Provisional application No. 60/434,353, filed on Dec. 17, 2002.

(51) Int. Cl.[7] ..... A63B 69/36

(52) U.S. Cl. ..... 473/280; 473/281

(58) Field of Search ..... 473/140, 141, 473/198, 199, 200, 280, 281

(56) References Cited

U.S. PATENT DOCUMENTS

| | | | | |
|---|---|---|---|---|
| 3,953,034 A | | 4/1976 | Nelson | 273/186 C |
| 4,878,674 A | | 11/1989 | Newcomb et al. | 273/213 |
| 5,169,150 A | * | 12/1992 | Tindale | 473/220 |
| 5,207,429 A | | 5/1993 | Walmsley et al. | 273/186.2 |
| 5,213,331 A | | 5/1993 | Avanzini | 273/186.3 |
| 5,388,831 A | | 2/1995 | Quadri et al. | 273/186.3 |
| 5,435,562 A | | 7/1995 | Stock et al. | 273/186.3 |
| 5,464,222 A | | 11/1995 | Carney | 273/186.3 |
| 5,472,204 A | | 12/1995 | English et al. | 273/186.3 |
| 5,564,707 A | | 10/1996 | Dinh | 473/218 |
| 5,818,036 A | * | 10/1998 | Daly | 250/216 |
| 5,964,668 A | | 10/1999 | Tai et al. | 473/220 |
| 6,011,466 A | | 1/2000 | Goldman | 340/825 |
| 6,238,298 B1 | | 5/2001 | Chen | 473/220 |
| 6,257,995 B1 | | 7/2001 | Schrimmer et al. | 473/353 |
| D448,059 S | * | 9/2001 | Battaglia | D21/791 |
| 6,579,191 B1 | * | 6/2003 | Hambly | 473/151 |
| 2002/0123385 A1 | | 9/2002 | Primiano et al. | 473/220 |
| 2004/0137997 A1 | * | 7/2004 | Rohrer | 473/220 |

* cited by examiner

*Primary Examiner*—Gregory Vidovich
*Assistant Examiner*—Nini F. Legesse
(74) *Attorney, Agent, or Firm*—Dean A. Craine

(57) ABSTRACT

A practice putting kit and training method for practicing the aiming a golf ball, aiming the putter, and keep returning the putter to a square position to the golf ball. The kit includes a laser golf ball that produces a planar, laser beam of light. Printed on the outer surface of the golf ball is a centrally aligned reference line aligned with the laser. The laser is connected to a control switch, an optional timer, and a battery that enables the golfer to selectively control its activation. The golfer practices aiming the reference line at the target line and then uses the laser to verify if aiming was correct. The kit also includes a stand that holds the golf ball in an elevated position behind the golfer. During use, a standard putter and golf ball is placed in front of the golfer and the stand and laser golf ball are positioned behind the golf ball and aimed at the golf ball so that the laser beam illuminates the top of the golf ball and the target line. The golfer watches the path of the golf ball and the putter head with respect to the laser line to determine if the putter was properly aimed and returned to a square position.

10 Claims, 2 Drawing Sheets

PUTTING PRACTICE KIT AND METHOD

This utility patent application is based on the provisional patent application (Ser. No. 60/434,353) filed on Dec. 17, 2002.

BACKGROUND OF THE INVENTION

1. Field of the Invention

The present invention relates to devices and methods for practicing putting a golf ball, and more particularly, to such devices and methods that helps a player properly aim the ball and putter and determine if the putter returns to square when striking the ball.

2. Description of the Related Art

Putters with large wide heads are popular today. Printed on the top surface of many putters is a reference line that is aligned with the head's center axis and perpendicular to the front face and used to properly aim the putter.

When putting, some golfers aim the ball at the cup. Typically, the golfer uses a ball with a reference centerline printed on the ball's surface that is longitudinally aligned with the target line to the cup. Typically, the golfer manually rotates the ball on the ground just prior to the putt so that the reference line is longitudinally aligned with the target line. Some golfers will align the reference line while standing directly over the ball and others will align the reference line while standing directly behind the ball. After the reference line on the golf ball has been properly aligned with the target line, the golfer then positions himself over the ball with the putter facing perpendicular to the reference line.

In order to properly execute a putt, the golfer must properly aim the putter at the desired target using the reference lines on the golf ball or on the putter. When the putter impacts the ball, the face of the putter should be aligned perpendicular with the target line. Like many physical activities, the acts of aiming the ball, aiming the putter at the target, and swinging the putter so that the putter head impacts the ball in a square position requires hundreds of hours of practice. In order to master these tasks, the golfer must continuously monitor the execution of these aspects of putting and take any corrective action or steps, if necessary, so that the desired outcome is obtained.

What is needed is a putting practice kit and training method that allows a user to practice aiming the ball, aiming the putter and returning with the putter head to a square position to the ball using his or her own putter.

SUMMARY OF THE INVENTION

It is an object of the present invention to provide a practice putting kit and training method that allows a user to practice aiming the ball, aiming the putter, and returning the putter head to a square position.

It is another object of the present invention to provided such a kit and method that is easy to use at home or on a standard putting green with the golfer's favorite putter.

These and other objects of the invention are met by a kit and training method disclosed herein that uses a laser golf ball with a built-in laser generating means disposed inside a regulation size golf ball body. The laser generating means is aligned inside the golf ball body so that planar laser beam of light is produced that is longitudinally aligned with the golf ball body's center axis. Printed on the outer surface of the golf ball is a centrally aligned reference line longitudinally aligned with the laser beam. The laser generating means is connected to a control switch, an optional timer, and a battery that enables the golfer to selectively control its activation. In the preferred embodiment, the control switch, timer and battery are mounted inside a control box electrically connected to the golf ball body. In a second embodiment, the control switch, timer and battery are mounted inside the golf ball body. The golfer practices aiming the reference line on the golf ball body at the target line and then uses the laser generating means to verify if the aim was correct.

The kit also includes a stand that holds the golf ball body in an elevated position behind the golfer. During use, a standard regulation golf ball is placed in front of the golfer. The stand and golf ball body are positioned behind the regulation ball and aimed at the golf ball so that the laser beam illuminates the top of the ball, the top of the putter, and the target line. The golfer watches the path of the golf ball and the location of the laser beam on the top of the putter head as the putter is swung to determine if the putter was properly aimed returned to a and square position.

DESCRIPTION OF THE PREFERRED EMBODIMENT(S)

Figure 3:
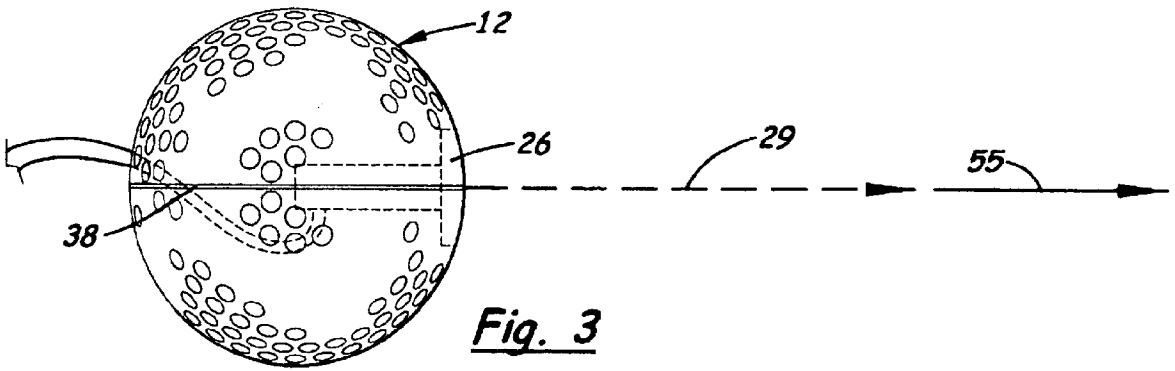
FIG. 3 is top plan view of the first embodiment of the laser golf ball showing the alignment of the laser beam with the reference line of the golf ball body.

Referring to the Figs. there is shown a golf putting kit, generally referenced as 10, that includes a laser golf ball 12 with a built-in laser beam generating means 20. Printed or formed on the sides of the golf ball 10 is a centrally aligned reference line 38 as shown in FIG. 3. In the preferred embodiment, the laser beam generating means 20 is a laser generating diode 21 mounted inside a centrally aligned bore 22 formed inside a golf ball body 13 or 13'. A laser-reflecting prism 26 is mounted over the laser generating diode 21 that is used to produce a vertically aligned, planar laser beam denoted as 29.

The planar laser beam 29 is preferred over a pinpoint laser beam because it produces a projected light "line" from the laser golf ball to the target. The laser beam 29 is oriented vertically so that a continuous line is produced with the center axis of the golf ball body 13 or 13' is diagonally aligned When a golf ball or putter is placed in the field of the laser beam 29, a portion of the laser beam 29 is seen on the golf ball 70 and putter 75. Typically, a stand 15, is used to slightly elevate the laser golf ball 12 so that laser beam 29 is scattered downward to delineate the path of the laser beam 29 on the ground.

During use, the laser golf ball 12 or 12' is aimed so that the scattered laser beam 29 extends from the golf ball 70 to the intended target. Because the player has a visual reference that extends from the golf ball 70 to the target, when the golf ball 70 is struck, the player may observe its path of travel relative to the target line.

Figure 1:
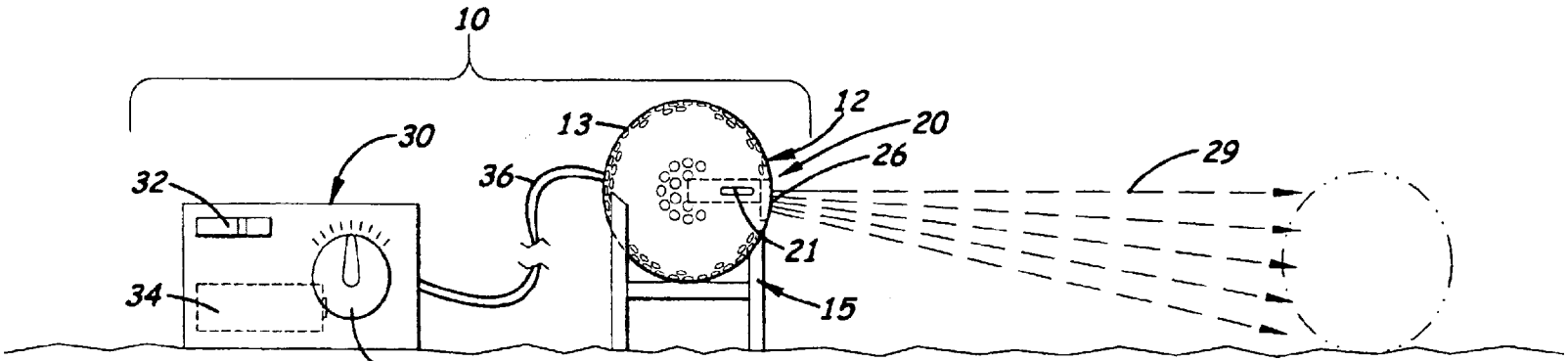
FIG. 1 is a side elevation view of the putting practice kit disclosed herein shown with the first embodiment of the laser golf ball.

In the first embodiment of the laser golf ball 12 shown in FIGS. 1 and 3, the laser generating diode 21 is electrically connected via a wire 36 or a wireless communication means to a control switch 32 and battery 34 housed inside a control box 30. Located inside the control box 30 is an optional tinier 40 that allows the golfer to selectively control when and how long the laser beam 29 is activated.

Figure 2:
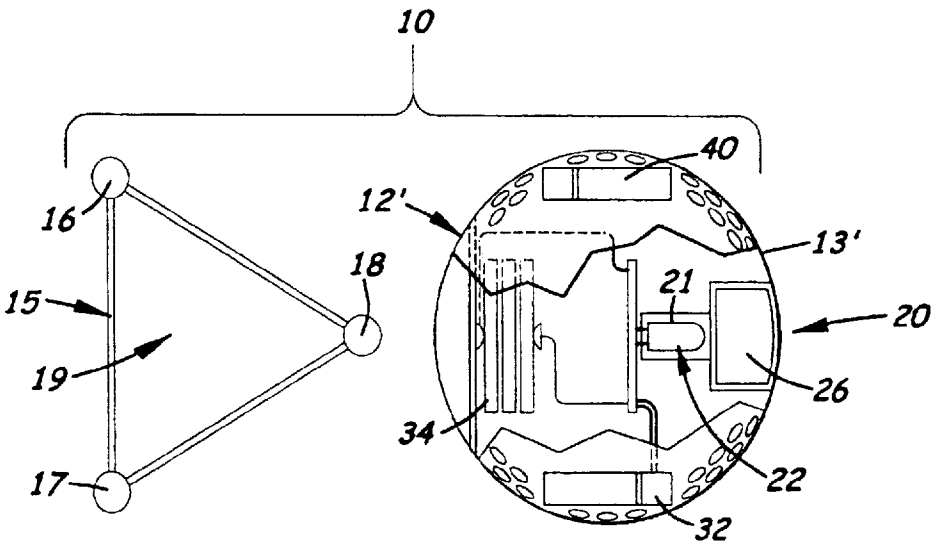
FIG. 2 is a sectional side elevational view of the second embodiment of the laser golf ball.

In a second embodiment of the laser golf ball 12' shown in FIG. 2, the laser generating diode 21, control switch 32, battery 34, and timer 40 are all mounted inside a regulation-size golf ball body 13'.

The kit 10 also includes a stand 15 designed to hold the laser golf ball 12 or 12' to elevate the laser golf ball 12 or 12' one to two inches above the putting green. In the preferred embodiment, the stand 15 includes three legs 16, 17, and 18 and attached to a triangular base 19. As mentioned above, when using the kit to practice aiming the putter and returning squaring the putter to a square position, the laser golf ball 12 or 12' is placed on the stand 15.

Aiming the Ball

When using the kit 10 to practice aiming a golf ball 70 at the cup, the user stands over or behind the laser golf ball 12 or 12' and rotates it so that the reference line 38 is longitudinally aligned with the target line 55 as shown in FIG. 3. After the golfer has aimed the ball, the laser generating diode 21 is activated to produce the illuminated beam 29. If the reference line 38 on the laser golf ball 12 is properly aimed at the target line 55, the laser beam 29 illuminates the desired target line 55. If the reference line 38 is not properly aimed, the golfer can easily determine if the laser golf ball 12 was mis-aligned and what corrective action should be taken. By repeating the exercise, the golfer slowly becomes trained at aiming the ball at the target line 55 when by standing behind or over the ball.

Aiming the Putter

As stated above, the kit 10 is also used to properly aim the putter 75 at the target 55 and to square the putter 75 on a standard golf ball 70. In order to practice aiming the putter 75 at the target 55, the laser golf ball 12 or 12' placed on an elevating stand 15 behind the regulation golf ball 70 used for putting. The laser golf ball 12 or 12' is rotated so that the laser beam 29 is simultaneously aimed at the target line 55 and illuminates the reference line 76 when the putter 75 swings at the golf ball 70. The golf ball 70 is placed in the putting area and aligned with the laser beam 29 so that the laser beam 29 bi-sects the golf ball 70 and the reference line 76 of the putter 75.

Determining if the Putter is Square

Figure 4:
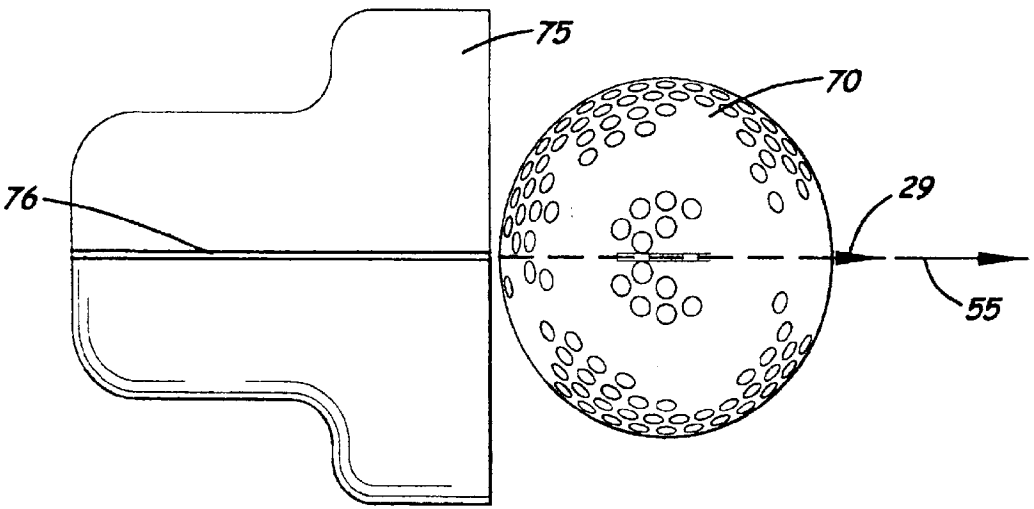
FIG. 4 is an illustration showing a putter adjacent to a regulation ball with the laser beam produced by the laser golf ball extending over the reference line on the putter and on the regulation golf ball.

When executing a putt, the laser golf ball 12 or 12' are placed on the stand 15 so that the laser beam 29 crosses over the top of the putter 75 and illuminates the top portion of the golf ball 70 as shown in FIG. 4. By monitoring whether the laser beam 29 is aligned with the reference line 76 on the top of the putter 75, the golfer can determine if the putter 75 was square on the golf ball 70 at impact. The optional timer 40 is connected to the laser generating diode 21 that allows the golfer to selectively control activation of the laser beam 29 during use. For example in some instances, it may be desirable to keep the laser beam 29 constantly activated so that the target line 55 is illuminated at all times. In other instances, it may be desirable to intermittently activate the laser generating diode 21 so that that laser beam 29 is momentarily discontinued during a shot so that the golfer's eyes are properly trained to look at specific directions.

Using the above-described kit, a method of practicing aiming a golf ball is provided, comprised of the following steps;

a. selecting a laser golf ball 12 with a built in planar laser beam generating means 20 and a reference line 38 formed on said ball's outer surface, said reference line being longitudinally aligned with a laser beam 29 formed by said laser beam generating means 20;

b. placing said laser golf ball 12 in the putting area;

c. visually aiming said reference line 38 with a desired target line 55; and, d. activating said laser-generating means to verify if the reference line 38 has been aimed properly at said target line 55.

Using the above described kit, a method of practicing aiming the putter and determining if the putter head is square with a golf ball when hit is also provided, comprising the following steps:

a. selecting a laser golf ball 12 with a built in planar, laser beam generating means 20 and a reference line 38 formed on said ball's outer surface, said reference line 38 being longitudinally aligned with a laser beam 29 formed by said laser beam generating means 20;

b. placing said laser golf ball 12 in an elevated position behind the putting area;

c. placing a golf ball 70 in said putting area.

d. activating and aiming said laser beam generating means so that said laser beam 29 illuminates the top portion of said golf ball 70 and the target line from said golf ball to the cup;

e. putting said golf ball 70 with a putter 75 and monitoring the path of the golf ball 70 with respect to said illuminated target line 55, whether the laser is aligned with a reference line 38 on the putter 75, and the area of said putter illuminated by said laser beam 29 when said putter 75 impacts said golf ball 70.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A practice putter kit, comprising:

a. a laser golf ball with a built in planar laser beam generating means and a reference line formed on said ball's outer surface, said reference line being longitudinally aligned with a laser beam formed by said laser beam generating means;

b. means to control the activation of said laser beam generating means; and, c. a stand used to hold said laser golf ball in an elevated positioned above the putting green.

2. The practice putter kit, as recited in claim 1, wherein said laser beam generating means includes a prism mounted over said laser generating diode to produce a planar laser beam.

3. The practice putter kit, as recited in claim 1, wherein said means to control the activation of said laser beam generating means is an external control box containing a control switch and battery electrically connected to said laser beam generating means.

4. The practice putter kit, as recited in claim 1, wherein said laser beam generating means is a laser generating diode.

5. The practice putter kit, as recited in claim 3, wherein said laser beam generating means is a laser generating diode.

6. The practice putter kit, as recited in claim 1, wherein said means to control the activation of said laser beam generating means is a control switch and battery electrically connected to said laser beam generating means and mounted inside said laser golf ball.

7. The practice putter kit, as recited in claim 6, wherein said laser beam generating means is a laser generating diode.

8. The practice putter kit, as recited in claim 7, wherein said laser beam generating means includes a prism mounted over said laser generating diode to produce a planar laser beam.

9. A method of practicing aiming a golf ball is provided, comprising the following steps;

a. selecting a laser golf ball with a built in planar laser beam generating means and a reference line formed on said ball's outer surface, said reference line being longitudinally aligned with a laser beam formed by said laser beam generating means;

b. placing said laser golf ball in the putting area;

c. visually aiming said reference line with a desired target line; and, d. activating said laser generating means to verify if the reference line has been aimed properly at said target line.

10. A method of practicing aiming the putter and determining if the putter head is square with a golf ball when hit is also provided, comprising the following steps:

a. selecting a laser golf ball with a built in planar, laser beam generating means and a reference means formed on said ball's outer surface, said reference line being longitudinally aligned with a laser beam formed by said laser beam generating means;

b. placing said laser golf ball in an elevated position behind the putting area;

c. placing a golf ball in said putting area;

d. activating and aiming said laser beam generating means so that said laser beam illuminates the top portion of said golf ball and the target line from said golf ball to the cup;

e. putting said golf ball with a putter and monitoring the path of the ball with respect to said illuminated target line and the area of said putter illuminated by said laser beam when said putter impacts said ball.

* * * * *